US007857378B2

(12) United States Patent
Smith

(10) Patent No.: US 7,857,378 B2
(45) Date of Patent: Dec. 28, 2010

(54) SEATING APPARATUS

(76) Inventor: Zachary Lee Smith, 14660 S. Constance Ct., Olathe, KS (US) 66062

( * ) Notice: Subject to any disclaimer, the term of this patent is extended or adjusted under 35 U.S.C. 154(b) by 135 days.

(21) Appl. No.: 12/212,380

(22) Filed: Sep. 17, 2008

(65) Prior Publication Data

US 2010/0066131 A1 Mar. 18, 2010

(51) Int. Cl.
*A47C 7/62* (2006.01)

(52) U.S. Cl. ..... 297/16.2; 297/17; 297/217.1; 5/419; 224/576

(58) Field of Classification Search ..... 297/16.2, 297/17, 129; 5/187, 419; 224/576, 651
See application file for complete search history.

(56) References Cited

U.S. PATENT DOCUMENTS 3,404,915 A * 10/1968 De Souza ..... 297/17
4,466,517 A * 8/1984 Spiegelman ..... 297/377
4,889,383 A * 12/1989 Jones ..... 297/16.1
5,570,829 A * 11/1996 Harrison ..... 224/651
5,779,112 A * 7/1998 Krulik ..... 297/129
5,785,219 A * 7/1998 Kraft ..... 224/576
5,876,091 A * 3/1999 Chernomashentsev ..... 297/16.2
6,030,034 A * 2/2000 Plohetski ..... 297/188.06
6,164,726 A 12/2000 Reeves et al.
6,223,367 B1 * 5/2001 French et al. ..... 5/419
2006/0049672 A1 * 3/2006 Terrell ..... 297/17

* cited by examiner

*Primary Examiner*—Peter R. Brown
(74) *Attorney, Agent, or Firm*—Lathrop & Gage LLP

(57) ABSTRACT

Various embodiments of a seating apparatus are set forth herein. In one embodiment, a seating apparatus includes a folding chair, bag, and blanket. The folding chair is movable between use and storage configurations. The bag has an internal area to receive the folding chair at the storage configuration. The bag has opposed ends and a length therebetween; an opening is at one end for passing the folding chair to and from the internal area. The blanket has a primary portion and at least one flap. An end of the primary portion is coupled to the bag and extends along at least a section of the bag length. The flap is sized to extend from the primary portion beyond a bag end and is not directly coupled to the bag. At least one fastener is configured to selectively couple the blanket to itself when the blanket is wrapped around the bag.

19 Claims, 6 Drawing Sheets

SEATING APPARATUS

BACKGROUND

The present invention relates generally to mobile chairs, and specifically to chairs that may be folded for transport.

SUMMARY

According to one embodiment, a seating apparatus includes a folding chair, a bag, and a blanket. The folding chair is movable between a use configuration and a collapsed storage configuration. The bag has an internal area configured to receive the folding chair when the folding chair is at the storage configuration and an opening for passing the folding chair to and from the internal area. The bag has opposed ends and a length between the ends, and the opening is at one of the ends. The blanket has a primary portion and at least one flap. An end of the primary portion is coupled to the bag and extends along at least a section of the bag length. The flap is sized to extend from the primary portion beyond one of the bag ends and is not directly coupled to the bag. At least one fastener is configured to selectively couple the blanket to itself when the blanket is wrapped around the bag.

According to another embodiment, a seating apparatus includes a folding chair, a bag, and a blanket. The folding chair is movable between a use configuration and a collapsed storage configuration. The bag has an internal area configured to receive the folding chair when the folding chair is at the storage configuration and an opening for passing the folding chair to and from the internal area. The bag has opposed ends and a length between the ends, and the opening is at one of the ends. The blanket has a primary portion between two flaps. A proximal end of the primary portion is coupled to the bag and extends along at least a section of the bag length. The primary portion includes an insulating layer and a waterproof layer. Each flap extends from the primary portion beyond a respective bag end when at an open configuration, and each flap is not directly coupled to the bag. At least one fastener is coupled to the blanket to selectively maintain the blanket wrapped around the bag with the waterproof layer exposed and the flaps at a closed configuration.

According to yet another embodiment, a seating apparatus includes a folding chair, a blanket, and a bag. The folding chair has a flexible seat portion, a flexible back portion, and a plurality of generally rigid legs movable between a use configuration and a collapsed storage configuration. The blanket has a primary portion with opposed proximal and distal ends and opposed sides. A flap extends from each side of the primary portion, and the primary portion includes an insulating layer and a waterproof layer. Each flap has an insulating layer. The bag has an internal area configured to receive the folding chair when the folding chair is at the storage configuration and an opening for passing the folding chair to and from the internal area. The bag is coupled to and extends along the blanket proximal end. At least one fastener selectively maintains the blanket wrapped around the bag.

DETAILED DESCRIPTION

Figure 4:
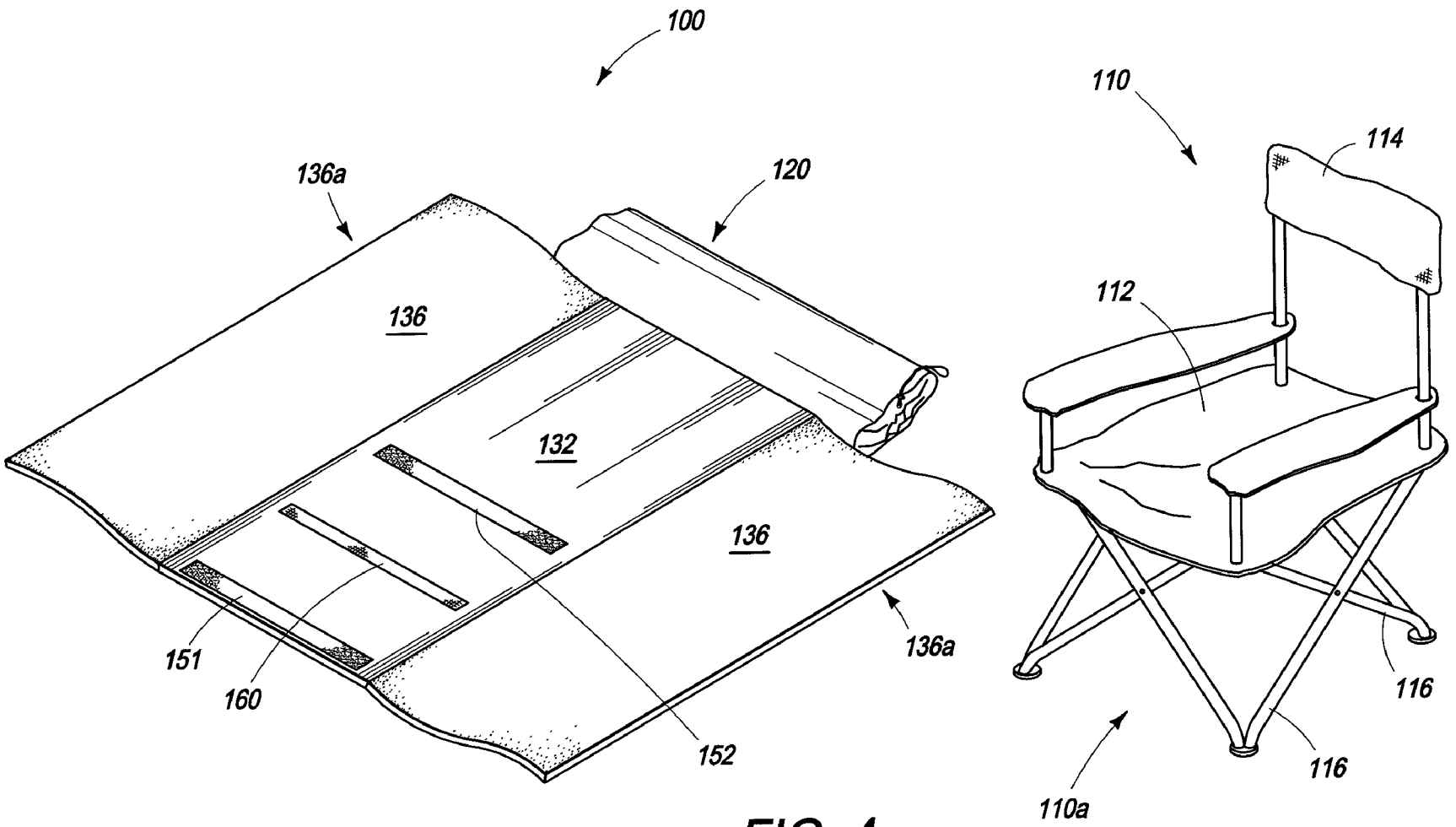
FIG. 4 is a perspective view of the seating apparatus of FIG. 1, shown with the folding chair at a use configuration.
Figure 5:
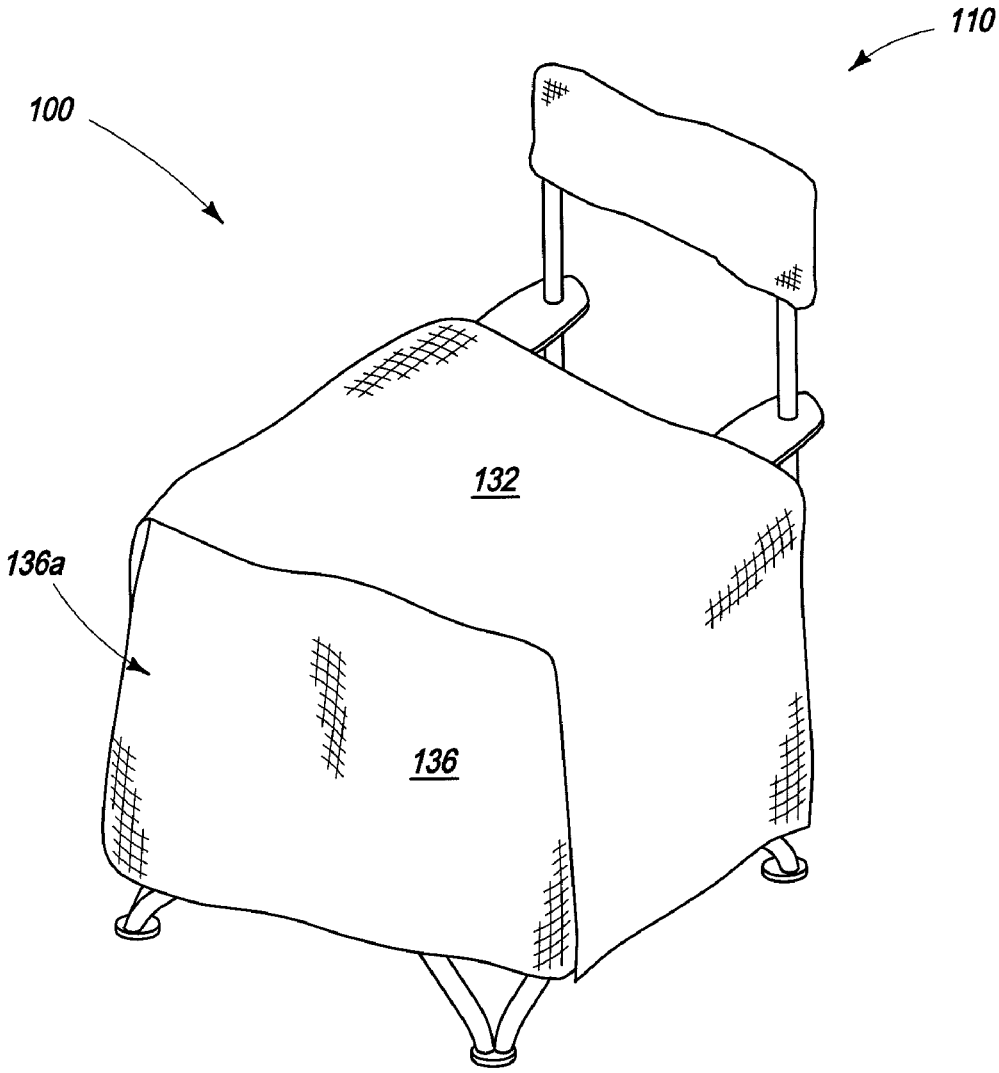
FIG. 5 is a perspective view of the seating apparatus of FIG. 1, shown with the folding chair at a use configuration and the blanket at a use configuration.

FIGS. 1-8 show a seating apparatus 100 that includes a folding chair 110, a bag 120, and a blanket 130. The folding chair 110 is movable between a collapsed storage configuration (e.g., inside the bag 120 in FIG. 1 and FIG. 7) and a use configuration 110*a* (FIG. 4 and FIG. 5). In some embodiments, the folding chair 110 has a flexible seat portion 112, a flexible back portion 114, and a plurality of generally rigid legs 116 (FIG. 4) movable between the storage configuration and the use configuration 110*a*. It should be understood that various types of folding chairs 110 may be used.

Figure 1:
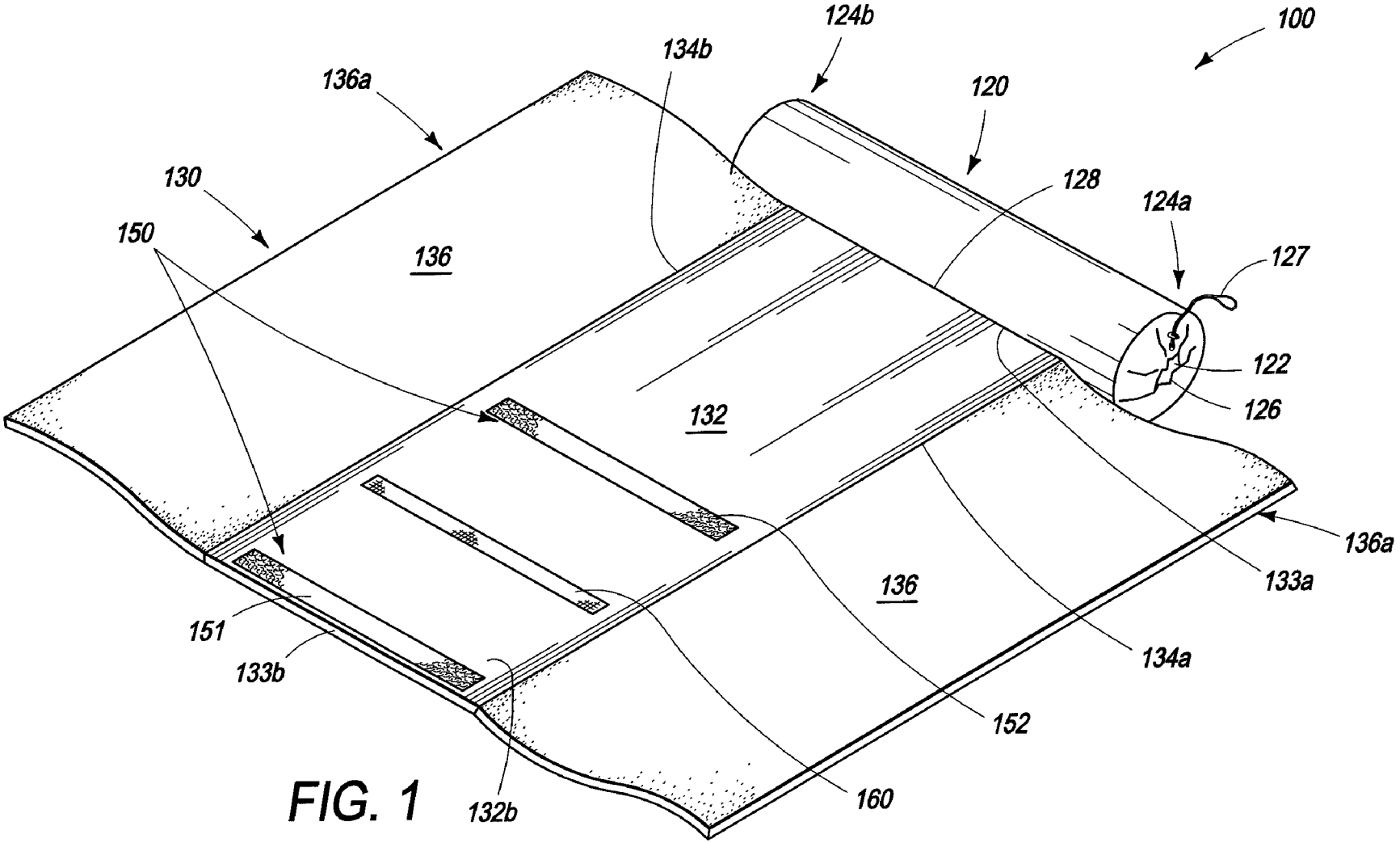
FIG. 1 is a perspective view of a seating apparatus according to an embodiment, shown with the folding chair inside the bag and the blanket at a use configuration.
Figure 7:
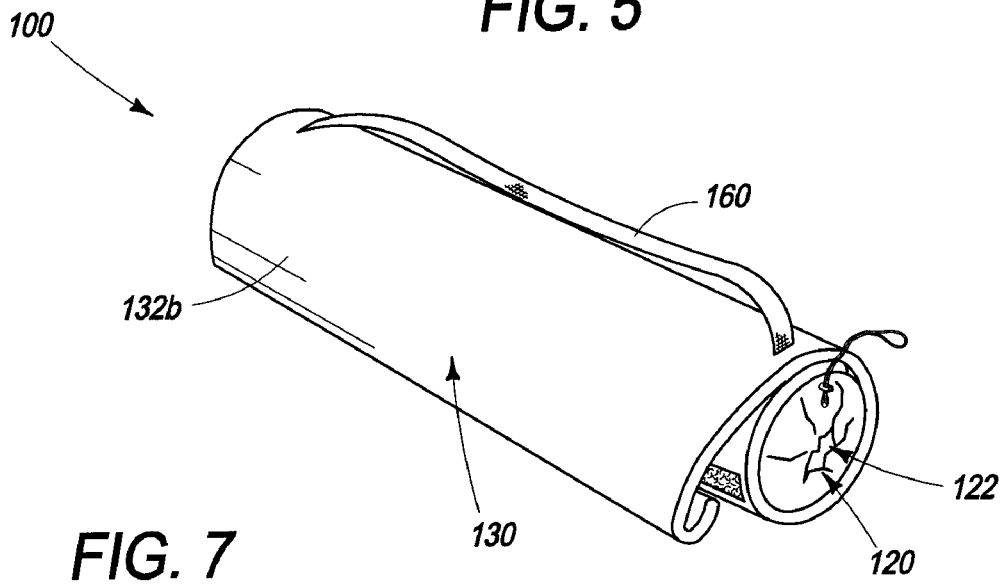
FIG. 7 is a perspective view of the seating apparatus of FIG. 1, shown with the folding chair inside the bag and the blanket wrapped around the bag.

As shown in FIG. 1 and FIG. 7, the bag 120 has an internal area 122 that is configured to receive the folding chair 110 when the folding chair 110 is at the storage configuration. The bag 120 has opposed ends 124*a*, 124*b* separated by a length 125 (FIG. 2), and an opening 126 (FIG. 1) allows access to the internal area 122 for passing the folding chair 110 to and from the internal area 122. In some embodiments, the opening 126 is at one of the ends 124*a*, 124*b*, as shown in FIG. 1. A drawstring 127, zipper, or other element may be included to close or restrict the opening 126. The bag 120 may be constructed of nylon, canvas, or any other appropriate material, and may include a seam 128 (FIG. 1) extending along the length 125.

Figure 2:
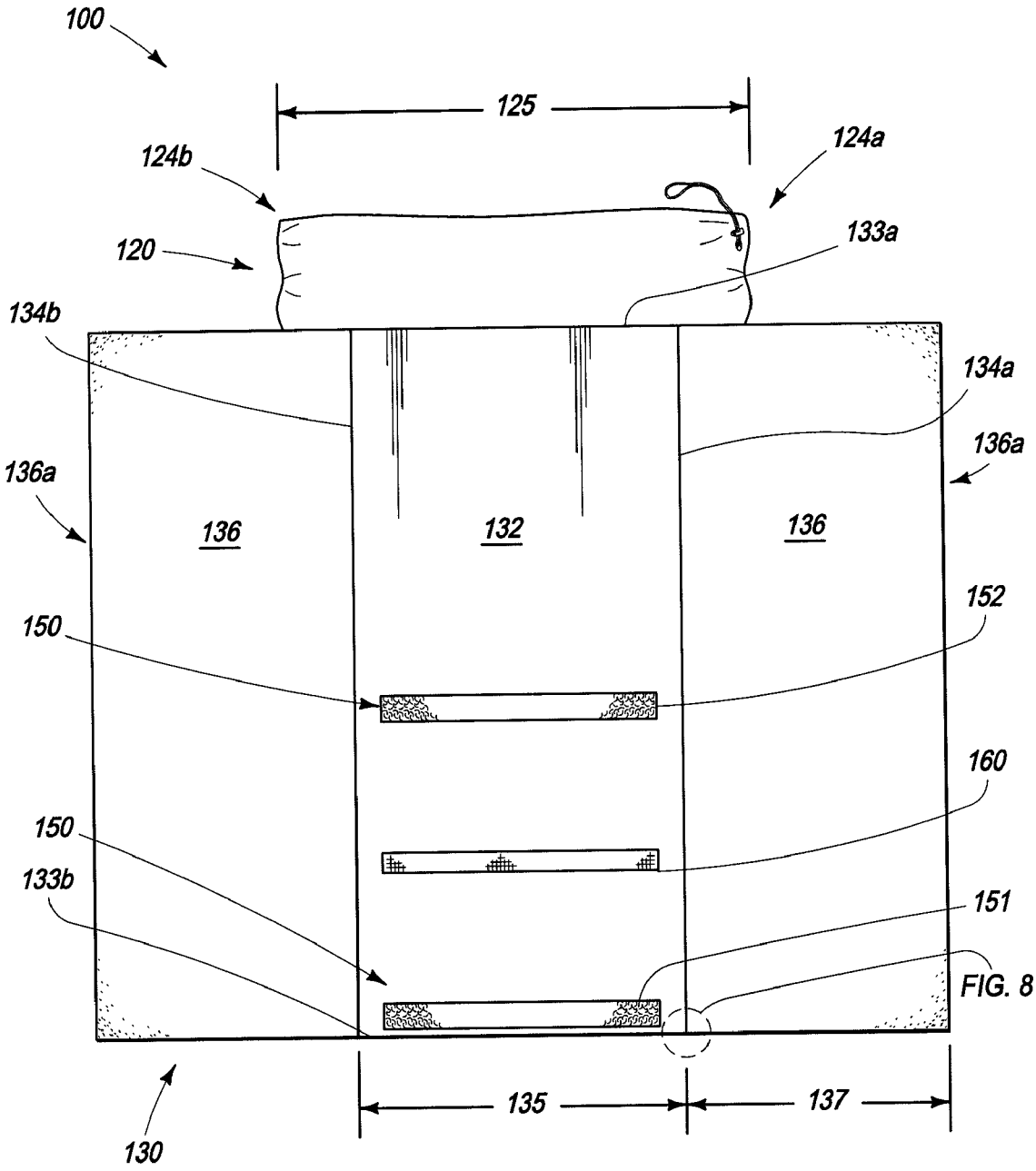
FIG. 2 is a top view of FIG. 1.
Figure 3:
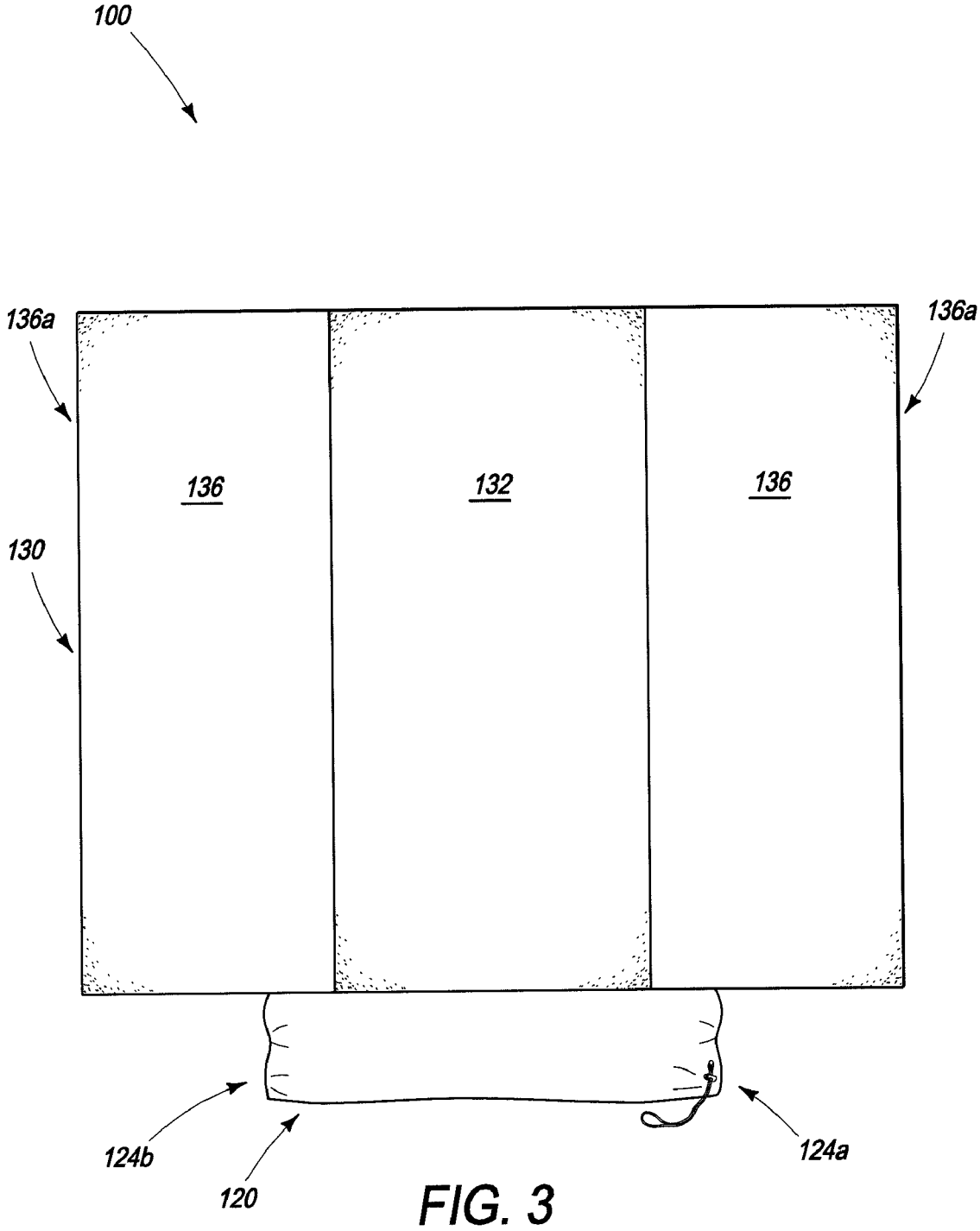
FIG. 3 is a bottom view of FIG. 1.

The blanket 130 includes a primary portion 132 with opposed proximal and distal ends 133*a*, 133*b* and opposed sides 134*a*, 134*b* (FIG. 1 and FIG. 2). The proximal end 133*a* is coupled to the bag 120 and extends along at least a section of the bag length 125. The primary portion 132 may be coupled to the bag 120 along the seam 128 (FIG. 1) and may be inwardly offset from the bag ends 124*a*, 124*b* (FIG. 2). A strap 160 (FIG. 1 and FIG. 7) may be coupled to the bag 120 or the blanket 130.

Figure 6:
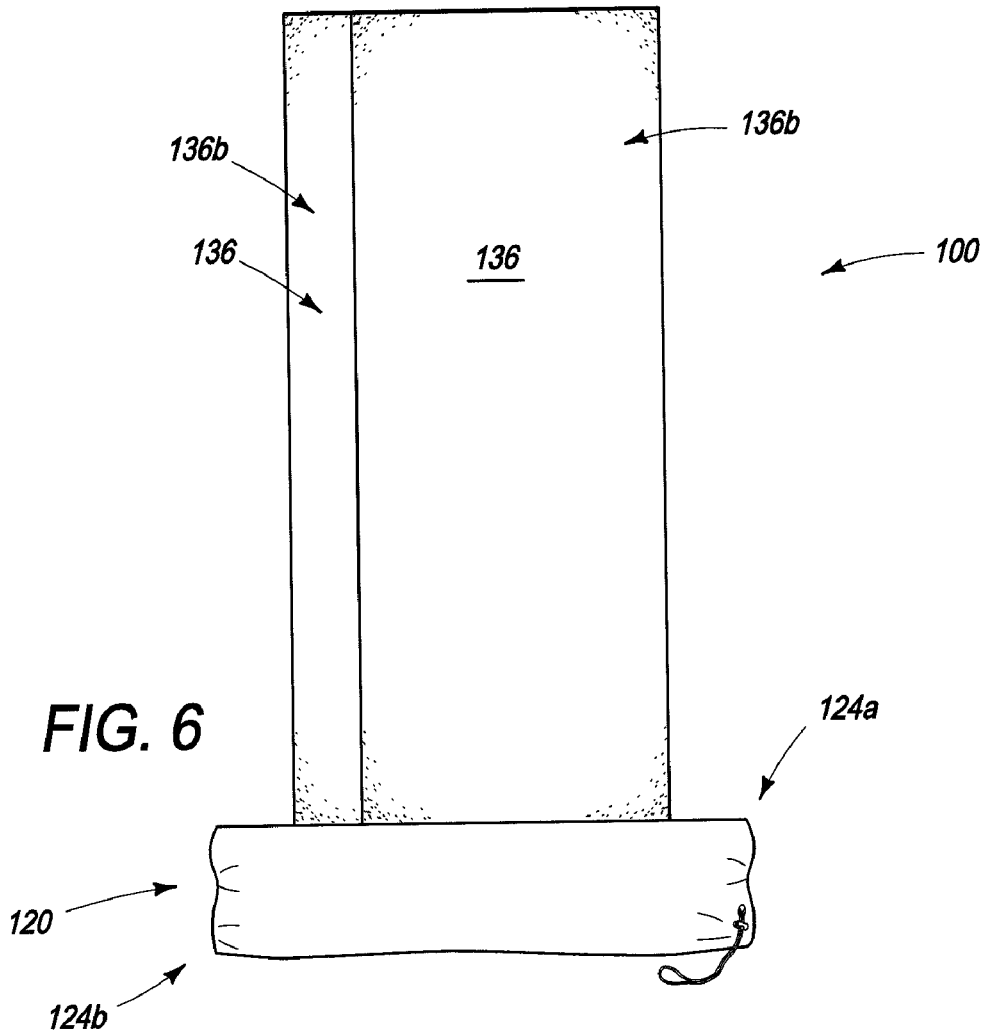
FIG. 6 is a perspective view of the seating apparatus of FIG. 1, shown with the blanket at a folded configuration.

At least one flap 136 extends from the primary portion 132, and a flap 136 may extend from each side 134*a*, 134*b* of the primary portion 132, as shown throughout the drawings. Each flap 136 is movable between an open (i.e., extended or "use") configuration 136*a*, as shown in FIGS. 1-5, and a closed (i.e., inwardly folded or "folded") configuration 136*b* (FIG. 6). Each flap 136 has a length 137 that extends from the primary portion 132 beyond a respective bag end 124*a*, 124*b* when at the open configuration 136*a* (FIG. 2), but that is less than a length 135 between the sides 134*a*, 134*b* (FIG. 2). The length 137 of each flap 136 may or may not be equal to one another. As shown in FIG. 1, the flaps 136 are not directly coupled to the bag 120 in at least some embodiments. While the primary portion 132 and the flaps 136 are shown throughout the drawings as being generally rectangular, other configurations may also be employed, including (but not limited to) polygonal (e.g., triangular, etc.) and rounded configurations.

Figure 8:
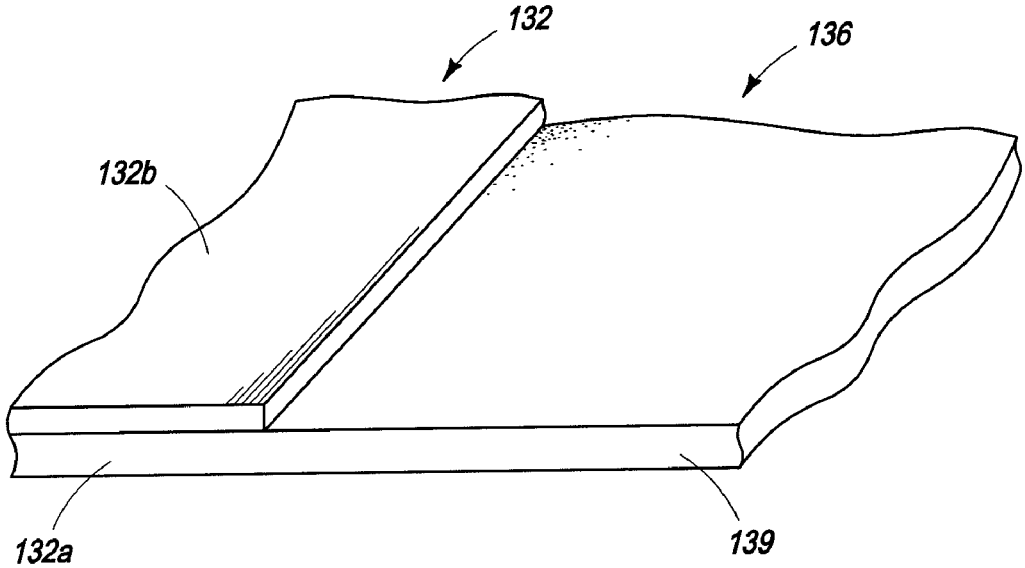
FIG. 8 is a partial perspective view taken from FIG. 2.

As shown in FIG. 8, the primary portion 132 includes an insulating layer 132*a* and a waterproof layer 132*b*, and the flaps 136 include at least an insulating layer 139. The insulating layers 132*a*, 139 may be constructed of fleece, wool, cloth, synthetic fiber, or other insulating materials; the waterproof layer 132*b* may be constructed of nylon or any other fabric that resists water from passing through. The insulating layers 132*a,* 139 may be a single continuous sheet of insulating material (as shown in FIG. 8), or may be separate sheets of material coupled together.

Returning to FIG. 1 and FIG. 2, at least one fastener 150 is included to selectively maintain the blanket 130 wrapped around the bag 120. More particularly, the fastener(s) 150 are attached to the blanket 130 to couple the blanket 130 to itself when the blanket 130 is wrapped around the bag 120 with the waterproof layer 132*b* exposed and the flaps 136 at the folded configuration 136*b* (FIG. 7). The fastener(s) 150 may include, for example, a hook and loop fastener, a snap, a clasp, a tie, and/or any other appropriate fastening device. In the embodiment set forth in FIG. 1, the fastener 150 includes complementary strips 151, 152 of hook and loop fasteners coupled to the blanket 130. Strip 151 is coupled to the waterproof layer 132*b* at the distal end 133*b* of the primary portion 132, and strip 152 is coupled to the waterproof layer 132*b* between the distal and proximal ends 133*b,* 133*a* of the primary portion 132. The strip 152 is closer to the distal end 133*b* than to the proximal end 133*a*.

In use, the seating apparatus 100 may initially be configured as shown in FIG. 7 (i.e., with the blanket 130 wrapped around the bag 120 and the chair 110 inside the bag 120) and may be easily transported (e.g., using the strap 160); the fastener(s) 150 may keep the blanket 130 wrapped around the bag 120 (e.g., interaction between strips 151, 152). The fastener(s) 150 may then be manipulated such that the blanket 130 is allowed to unwrap, as shown in FIG. 6, and the flaps 136 may be moved to the open configuration 136*a,* as shown in FIGS. 1-4. The folding chair 110 may be removed from the bag 120 and moved to the use configuration 110*a* (FIG. 4), either before or after the flaps 136 are moved to the open configuration 136*a,* and the blanket 130 may be used to keep a person sitting in the chair 110 warm and/or dry (FIG. 5). While the primary portion 132 of the blanket 130 is shown in FIG. 5 to extend across the chair 110, the flaps 136 may instead extend on each side of the chair 110 (i.e., the blanket 110 may be rotated ninety degrees from the configuration shown in FIG. 5), or the blanket may otherwise be used as desired.

To then transport the seating apparatus 100, the folding chair 110 may be placed in the internal area 122 of the bag 120 through the opening 126, and the flaps 136 may be moved to the closed configuration 136*b,* as shown in FIG. 6. The blanket 130 may then be wrapped around the bag 120 (FIG. 7), and the fastener(s) 150 may be manipulated to couple the blanket 130 to itself and maintain the blanket 130 wrapped around the bag 120. For example, the strip 151 may be coupled to the strip 152.

Those skilled in the art appreciate that variations from the specified embodiments disclosed above are contemplated herein and that the described embodiments are not limiting. The description should not be restricted to the above embodiments, but should be measured by the following claims.

I claim:

1. A seating apparatus, comprising:

a folding chair movable between a use configuration and a collapsed storage configuration;

a bag having an internal area configured to receive the folding chair when the folding chair is at the storage configuration and an opening for passing the folding chair to and from the internal area, the bag having opposed ends and a length therebetween, the opening being at one of the ends, the bag having a seam along the bag length;

a blanket having a primary portion between two flaps, a proximal end of the primary portion being coupled to the bag and extending along at least a section of the bag length, the primary portion including an insulating layer and a waterproof layer, each flap extending from the primary portion beyond a respective bag end when at an open configuration and not being directly coupled to the bag, the primary portion being offset from each bag end and having a length that is less than the bag length; and at least one fastener coupled to the blanket to selectively maintain the blanket wrapped around the bag with the waterproof layer exposed and the flaps at a closed configuration;

wherein the primary portion end is coupled to the bag along the bag seam; and wherein the at least one fastener includes:

a first portion coupled to the waterproof layer at a distal end of the primary portion; and a second complementary portion coupled to the waterproof layer between the distal and proximal ends of the primary portion.

2. The seating apparatus of claim 1, further comprising a handle attached to at least one of the bag or the blanket.

3. The seating apparatus of claim 2, wherein:

the insulating layer includes at least one material selected from the group consisting of:

fleece, wool, cloth, and synthetic fiber; and the waterproof layer includes nylon.

4. The seating apparatus of claim 1, wherein at least one of the flaps is generally rectangular.

5. The seating apparatus of claim 1, wherein at least one of the flaps is polygonal.

6. The seating apparatus of claim 1, wherein at least one of the flaps is rounded.

7. The seating apparatus of claim 1, wherein:

the fastener first portion includes a hook and loop fastening element; and the fastener second complementary portion includes a complementary hook and loop fastening element.

8. The seating apparatus of claim 7, further comprising a handle attached to at least one of the bag or the blanket.

9. The seating apparatus of claim 1, wherein the at least one fastener includes at least one of: a hook and loop fastener, a snap, a clasp, or a tie.

10. A seating apparatus, comprising:

a folding chair having a flexible seat portion, a flexible back portion, and a plurality of generally rigid legs movable between a use configuration and a collapsed storage configuration;

a blanket having a primary portion with opposed proximal and distal ends and opposed sides, a flap extending from each side of the primary portion, the primary portion including an insulating layer and a waterproof layer, each flap having an insulating layer;

a bag for housing the folding chair when the folding chair is at the storage configuration, the bag having an internal area configured to receive the folding chair when the folding chair is at the storage configuration and an opening for passing the folding chair to and from the internal area, the bag being coupled to and extending along the blanket proximal end; and at least one fastener to selectively maintain the blanket wrapped around the bag;

wherein the bag has opposed ends and a length therebetween, the opening being at one of the ends;

wherein the primary portion is offset from each bag end and has a length that is less than the bag length;

wherein each flap has a length that extends from the primary portion beyond a respective bag end when at an open configuration;

wherein each flap length is less than the primary portion length; and wherein the at least one fastener includes:

a hook and loop fastening element coupled to the waterproof layer at the distal end of the primary portion; and a complementary hook and loop fastening element coupled to the waterproof layer between the distal and proximal ends of the primary portion, the complementary hook and loop fastening element being closer to the distal end than to the proximal end.

11. The seating apparatus of claim 10, wherein:

the bag has a seam along the bag length;

the primary portion proximal end is coupled to the bag along the bag seam;

the primary portion insulating layer and the insulating layer of each flap is a single continuous sheet of insulating material;

the primary portion is generally rectangular; and each flap is generally rectangular.

12. The seating apparatus of claim 11, further comprising a handle attached to at least one of the bag or the blanket.

13. The seating apparatus of claim 10, wherein:

the bag has a seam along the bag length; and the primary portion proximal end is coupled to the bag along the bag seam.

14. A seating apparatus, comprising:

a folding chair movable between a use configuration and a collapsed storage configuration;

a blanket having a primary portion with opposed proximal and distal ends and opposed sides, a flap extending from each side of the primary portion, the primary portion including opposed interior and exterior faces;

a bag for housing the folding chair when the folding chair is at the storage configuration, the bag having an internal area configured to receive the folding chair when the folding chair is at the storage configuration and an opening for passing the folding chair to and from the internal area, the bag being coupled to and extending along the blanket proximal end, the bag having opposed ends and a length therebetween, the opening being at one of the bag ends; and at least one fastener to selectively maintain the blanket wrapped around the bag;

wherein the primary portion is offset from each bag end and has a length that is less than the bag length;

wherein each flap has a length that extends from the primary portion beyond a respective bag end when at an open configuration;

wherein each flap length is less than the primary portion length; and wherein the at least one fastener includes:

a portion extending from the exterior face at the distal end of the primary portion; and a complementary portion extending from the exterior face between the distal and proximal ends of the primary portion.

15. The seating apparatus of claim 14, wherein the at least one fastener includes at least one of: a hook and loop fastener, a snap, a clasp, or a tie.

16. The seating apparatus of claim 14, wherein:

the bag has a seam along the bag length;

the primary portion proximal end is coupled to the bag along the bag seam;

the primary portion exterior face is defined by a waterproof layer; and the primary portion interior face is defined by an insulating layer.

17. The seating apparatus of claim 16, wherein the insulating layer includes at least one material selected from the group consisting of:

fleece, wool, cloth, and synthetic fiber; and the waterproof layer includes nylon.

18. The seating apparatus of claim 16, further comprising a handle attached to at least one of the bag or the blanket.

19. The seating apparatus of claim 14, wherein the primary portion is generally rectangular and each flap is generally rectangular.

* * * * *